US006848430B2

(12) United States Patent
Bämpfer

(10) Patent No.: US 6,848,430 B2
(45) Date of Patent: Feb. 1, 2005

(54) FUEL FEED UNIT

(75) Inventor: Michael Bämpfer, Rotenburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/678,752

(22) Filed: Oct. 6, 2003

(65) Prior Publication Data

US 2004/0123844 A1 Jul. 1, 2004

(30) Foreign Application Priority Data

Oct. 7, 2002 (DE) ..... 102 46 725

(51) Int. Cl.[7] ..... F02M 37/04
(52) U.S. Cl. ..... 123/509; 417/363
(58) Field of Search ..... 123/509, 497; 417/360, 363

(56) References Cited

U.S. PATENT DOCUMENTS

| | | | | | |
|---|---|---|---|---|---|
| 4,945,884 | A | * | 8/1990 | Coha et al. | 123/509 |
| 5,007,806 | A | * | 4/1991 | Bellis et al. | 417/360 |
| 5,330,475 | A | * | 7/1994 | Woodward et al. | 417/89 |
| 5,445,503 | A | * | 8/1995 | Kmiec et al. | 417/360 |
| 5,647,330 | A | * | 7/1997 | Sawert et al. | 123/509 |
| 6,206,035 | B1 | * | 3/2001 | Wehner et al. | 137/565.16 |
| 6,293,256 | B1 | * | 9/2001 | Kleppner et al. | 123/509 |
| 6,644,289 | B2 | * | 11/2003 | Noda | 123/509 |
| 6,655,365 | B2 | * | 12/2003 | Beyer et al. | 123/509 |

* cited by examiner

*Primary Examiner*—Mahmoud Gimie
(74) *Attorney, Agent, or Firm*—Morrison & Foerster LLP

(57) ABSTRACT

In a fuel feed unit, a pump holder has a plurality of sheet-metal strips for limiting the transmission of structured-borne sound from a fuel pump to an anti-surge pot. The sheet-metal strips can be manufactured cost-effectively and adapted to the particular fuel pump. This enables the fuel feed unit to be manufactured particularly cost-effectively.

9 Claims, 1 Drawing Sheet

FUEL FEED UNIT

CLAIM FOR PRIORITY

This application claims the benefit of priority to German Application No. 102 46 725.0, filed Oct. 7, 2002, the contents of which are hereby incorporated by reference.

TECHNICAL FIELD OF THE INVENTION

The invention relates to a fuel feed unit which is provided for arrangement in a fuel tank of a motor vehicle, having a fuel pump and having a pump holder which is to be fastened in the fuel tank and is intended for securing the fuel pump.

BACKGROUND OF THE INVENTION

Fuel feed units of this type are in widespread use in modem motor vehicles and are known in practice. The pump holder of the known fuel feed unit is manufactured as a plastic part by injection molding and has a plurality of resilient elements for avoiding the transmission of annoying structure-borne sound from the fuel pump to adjacent components of the fuel tank. The pump holder is generally clipped to an anti-surge pot arranged in the fuel tank.

A disadvantage of the known fuel feed unit is that the pump holder is a component which is difficult to manufacture. A cost-intensive injection molding die is also required for this purpose.

SUMMARY OF THE INVENTION

The invention discloses a fuel feed unit of the type mentioned at the beginning in such a manner that it can be produced particularly cost-effectively and the transmission of structure borne sound from the fuel pump is largely avoided.

In one embodiment of the invention, there is a pump holder being manufactured, at least in a central region, from metal in order to acoustically isolate the fuel pump from adjacent components.

According to another advantageous embodiment of the invention, a contribution is made to further suppressing the transmission of structure-borne sound if the region which is manufactured from metal has different wall thicknesses.

According to another advantageous embodiment of the invention, vibrations from the fuel pump are reliably damped by the pump holder if a resonant frequency of that region of the pump holder which is manufactured from metal lies outside the natural frequency of the fuel pump.

A contribution is made to simplifying the installation of the fuel feed unit according to the invention if the pump holder has at least one retaining ring for fastening it to an adjacent component, and has sheetmetal strips protruding in a star-shaped manner from the retaining ring. The retaining ring may be fastened, for example, to the anti-surge pot or to the fuel pump. The pump holder preferably has one retaining ring in each case on the anti-surge pot and on the fuel pump, the retaining rings being connected to each other via the sheet-metal strips.

A contribution is made to further simplifying the installation of the fuel feed unit according to the invention if the retaining ring and the sheet-metal strips are manufactured as a single piece.

According to another advantageous development of the invention, the outlay for adapting the pump holder for different fuel pumps and different fuel tanks can be kept particularly small if the retaining ring is manufactured from plastic and the sheet-metal strips are pressed into corresponding grooves of the retaining ring.

According to another advantageous embodiment of the invention, the pump holder has particularly low stiffness transversely with respect to the longitudinal axis of a drive shaft of the fuel pump if that region of the pump holder which is manufactured from metal is arranged essentially parallel to the longitudinal axis of a drive shaft of the fuel pump. The fuel pump is able to move laterally, for example due to an imbalance in the drive shaft, without vibrations being transmitted to adjacent components of the fuel tank. For installation purposes, this enables the fuel pump to be fitted in a simple manner into an anti-surge pot.

BRIEF DESCRIPTION OF THE DRAWINGS

The invention is described in more detail below with reference to the drawings, in which.

DETAILED DESCRIPTION OF THE INVENTION

Figure 1:
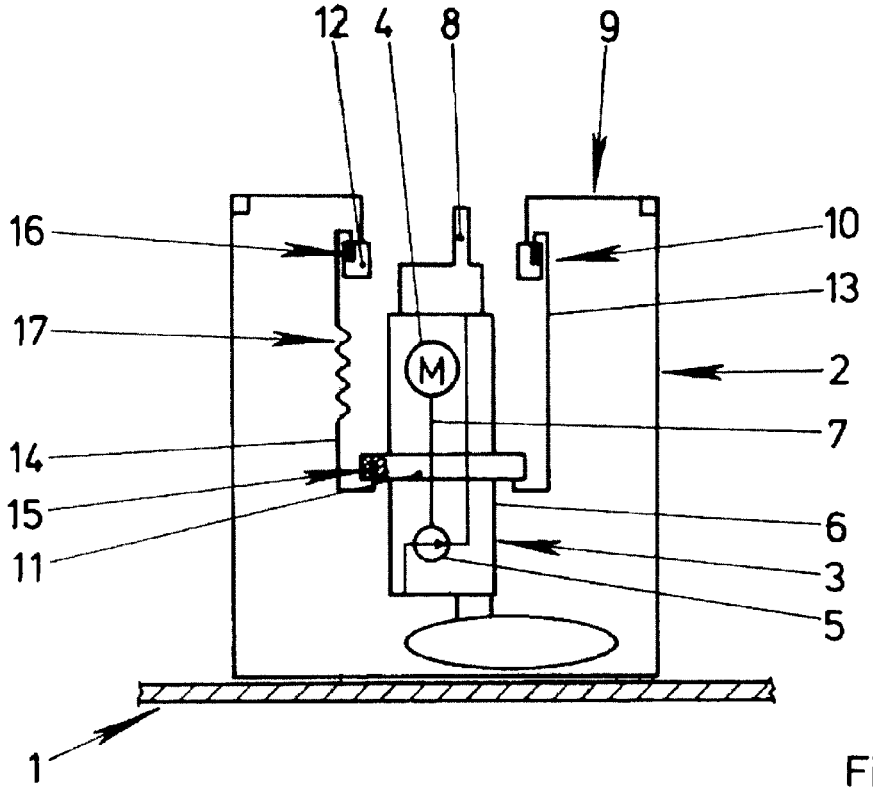
FIG. 1 shows schematically a fuel feed unit according to the invention.

FIG. 1 shows an anti-surge pot 2 which is prestressed against a bottom of a fuel tank 1 of a motor vehicle together with a fuel feed unit 3. The fuel feed unit 3 has a fuel pump 5 which is driven by an electric motor 4. The fuel pump 5 and the electric motor 4 are arranged in a common housing 6 and are connected to each other via a drive shaft 7. The fuel pump 5 sucks up fuel from the anti-surge pot 2 and feeds it to a connection 8 of the fuel feed unit 3, which connection can be connected to a forward-flow line (not illustrated). A cover 9 is clipped onto the anti-surge pot 2. The cover 9 is connected to a pump holder 10. The pump holder 10 has a retaining ring 11, 12, which is fastened to the cover 9 and to the housing 6 of the fuel pump 5, and has, in its central region, sheetmetal strips 13, 14 for connection of the retaining rings 11, 12. The retaining rings 11, 12 are manufactured here from plastic.

The sheet-metal strips 13, 14 extend essentially parallel to the drive shaft 7 of the fuel pump 5 and are pressed into grooves 15, 16 of the retaining rings 11, 12. Two sheet-metal strips 13, 14 are illustrated in the drawing. The pump holder 10 preferably has three sheet-metal strips 13, 14 which are arranged offset by 120° with respect to one another. As an alternative to the illustrated connection of the sheet-metal strips 13, 14 to the retaining rings 11, 12, the sheet-metal strips 13, 14 and the retaining rings 11, 12 can be manufactured as a single piece from metal. Components of this type can be manufactured in a simple manner by punching and deep-drawing. One of the sheet-metal strips 14 has corrugations 17 and is therefore designed such that it is elastic in its longitudinal direction. The sheet-metal strips 13, 14 largely suppress the transmission of structure-borne sound from the fuel pump 5 to the anti-surge pot 2.

Figure 2:
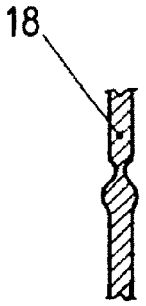
FIG. 2 shows a longitudinal section of a sheet-metal strip of the fuel feed unit according to the invention from FIG. 1.
Figure 3:
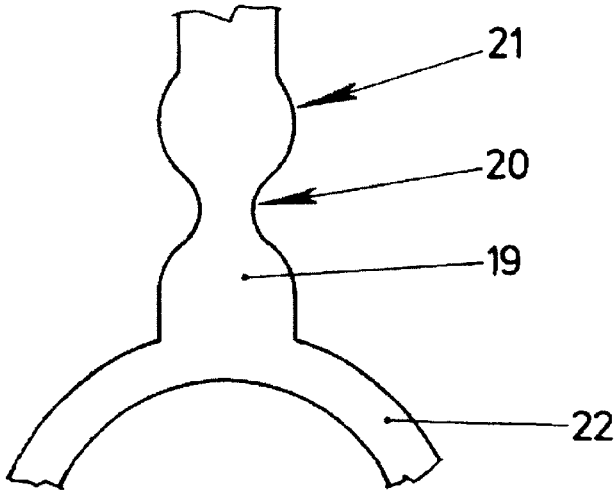
FIG. 3 shows a view of a sheet-metal strip of the fuel feed unit according to the invention from FIG. 1.

FIG. 2 shows a further embodiment of the sheet-metal strip 18 in longitudinal section, in which different wall thicknesses have been produced, for example by stamping. FIG. 3 shows a view of a further embodiment of a sheet-metal strip 19 with a constriction 20 and an enlargement 21. The sheet-metal strip 19 is manufactured as a single piece with a retaining ring 22 which is provided for fastening it to the fuel pump 5 from FIG. 1. The configuration of the sheet-metal strips 18, 19 according to FIGS. 2 and 3 obstructs the transmission of structure-borne sound from the fuel pump 5 illustrated in FIG. 1 to the anti-surge pot 2.

What is claimed is:

1. A fuel feed unit for arrangement in a fuel tank of a motor vehicle, comprising a fuel pump and a pump holder which is to be fastened in the fuel tank and secures the fuel pump, the pump holder is manufactured, at least in a central region, from metal to acoustically isolate the fuel pump adjacent components, wherein the sheet-metal strip has corrugations.

2. The fuel feed unit as claimed in claim 1, wherein the pump holder has a sheet metal strip in its central region.

3. The fuel feed unit as claimed in claim 1, wherein the pump holder has at least one retaining ring for fastening it to an adjacent component, and has sheet-metal strips protruding in a starshaped manner from the retaining ring.

4. The fuel feed unit as claimed in claim 1, wherein the retaining ring is manufactured from plastic and the sheet-metal strip are pressed into corresponding grooves of the retaining ring.

5. The fuel feed unit as claimed in claim 1, wherein the region of the pump holder which is manufactured from metal is arranged essentially parallel to the longitudinal axis of a drive shaft of the fuel pump.

6. A fuel feed unit for arrangement in a fuel tank of a motor vehicle, comprising a fuel pump and a pump holder which is to be fastened in the fuel tank and secures the fuel pump, the pump holder is manufactured, at least in a central region, from metal to acoustically isolate the fuel pump adjacent components, wherein the region which is manufactured from metal has constrictions and/or enlargements.

7. A fuel feed unit for arrangement in a fuel tank of a motor vehicle, comprising a fuel pump and a pump holder which is to be fastened in the fuel tank and secures the fuel pump, the pump holder is manufactured, at least in a central region, from metal to acoustically isolate the fuel pump adjacent components, wherein the region which is manufactured from metal has different wall thicknesses.

8. A fuel feed unit for arrangement in a fuel tank of a motor vehicle, comprising a fuel pump and a pump holder which is to be fastened in the fuel tank and secures the fuel pump, the pump holder is manufactured, at least in a central region, from metal to acoustically isolate the fuel pump adjacent components, wherein a resonant frequency of that region of the pump holder which is manufactured from metal lies outside the natural frequency of the fuel pump.

9. A fuel feed unit for arrangement in a fuel tank of a motor vehicle, comprising a fuel pump and a pump holder which is to be fastened in the fuel tank and secures the fuel pump, the pump holder is manufactured, at least in a central region, from metal to acoustically isolate the fuel pump adjacent components, wherein the retaining ring and the sheet-metal strip manufactured as a single piece.

* * * * *